United States Patent [19]

Howard

[11] Patent Number: 4,719,715

[45] Date of Patent: Jan. 19, 1988

[54] MAGAZINE CHARGER

[76] Inventor: William J. Howard, P.O. Box 573, Wilson, N.C. 27893

[21] Appl. No.: 39,294

[22] Filed: Apr. 17, 1987

[51] Int. Cl.[4] ..... F42B 39/06; F41C 27/00

[52] U.S. Cl. ..... 42/87

[58] Field of Search ..... 42/87, 90

[56] References Cited

U.S. PATENT DOCUMENTS

| | | | |
|---|---|---|---|
| 1,786,537 | 12/1930 | Holek | 42/87 |
| 2,403,012 | 7/1946 | McPheters | 42/87 |
| 2,451,521 | 10/1948 | Uglum | 42/87 |
| 4,304,062 | 12/1981 | Pepe et al. | 42/87 |
| 4,452,002 | 6/1984 | Musgrave | 42/87 |
| 4,464,855 | 8/1984 | Musgrave | 42/87 |
| 4,570,371 | 2/1986 | Mears | 42/87 |
| 4,574,511 | 3/1986 | Csongor | 42/87 |

*Primary Examiner*—Charles T. Jordan

*Attorney, Agent, or Firm*—Quaintance, Murphy & Presta

[57] ABSTRACT

A magazine charger having a body with a spring and an open end for receiving a magazine to be charged with cartridges. The body has a closed end with a passage having outwardly flared walls. A plunger is in the passage. The plunger is adapted to move cartridges against the magazine spring. The charger also has a plunger spring which biases the plunger away from the open end of the charger. The plunger is operable to sequentially depress the uppermost cartridge, facilitating feeding of the cartridges to a magazine having two parallel rows of cartridges.

13 Claims, 11 Drawing Figures

MAGAZINE CHARGER

Charging cartridges to the magazine of a firearm has always been slow and cumbersome. For members of the armed forces in combat situations this can potentially cause a loss of life.

The problems of charging a magazine by hand are particularly great when either (a) the magazine cannot be charged vertically downwardly or (b) the cartridges are short i.e., have a length less than about 3 cm. The magazine cannot be charged vertically downwardly then it is necessary to depress all previously loaded cartridges before additional cartridges can be loaded axially rearwardly. In cases where the cartridges are short it is difficult or impossible to charge a magazine by use of only human hands. Both of these problems and other problems occur in connection with the widely popular 9 mm magazine which has recently become the standard for armed forces of the North Atlantic Treaty Organization (NATO).

Many attempts have been made to overcome these problems and to provide magazine chargers. Examples of prior attempts are disclosed by Mauser in German Pat. No. 304,379 which issued in 1917; by Northover in U.S. Pat. No. 1,355,684 issued in 1920; by Holec in U.S. Pat. No. 1,786,537 issued in 1930; by McPheaters in U.S. Pat. No. 2,403,012 issued in 1946; by Uglum in U.S. Pat. No. 2,451,521 issued on the 19th day of Oct. 1948; by Drew in U.S. Pat. No. 2,864,193 issued in 1958; by Howard in U.S. Pat. No. 4,538,371 issued on the 3rd day of Sept. 1985; U.S. Pat. No. 4,570,371 issued on the 18th day of Feb. 1986; and by Csongor in U.S. Pat. No. 4,574,511 issued on the 11th day of Mar. 1986.

All the above described magazine chargers suffer from one or more disadvantages. Many are expensive to make. Several do not function in the manner in which they are designed. Some cannot be efficiently operated by a single person. Others do not function smoothly with magazines having two parallel rows of cartridges.

Accordingly it is an object of the present invention to provide an improved magazine charger which is substantially free of one or more of the disadvantages of prior chargers. Another object is to provide an improved magazine charger which is inexpensive to manufacture.

Another object is to provide an improved magazine charger which can be employed to quickly and efficiently charge cartridges to a magazine.

Still another object is to provide an improved magazine charger that can be operated by a single individual.

Yet another object of the present invention is to provide an improved magazine charger which is especially useful with 9 mm cartridges.

An additional object is to provide a magazine charger that functions smoothly when used with a magazine having two rows of cartridges which are side-by-side.

Figure 1:
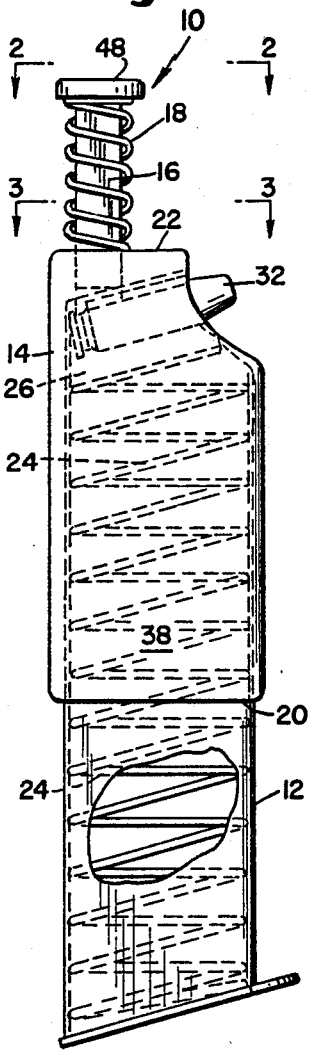
Figure 2:
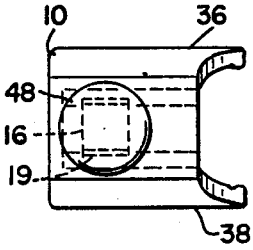
Figure 3:
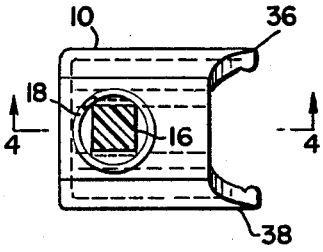
Figure 4:
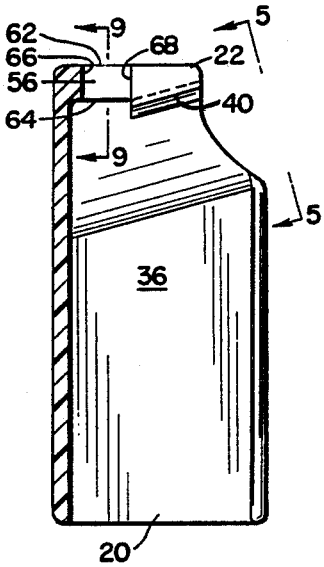
Figure 5:
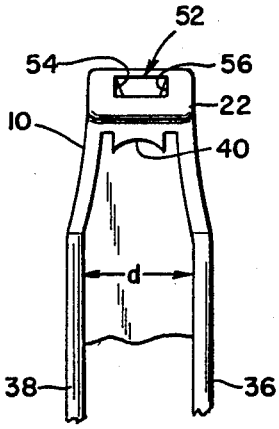
Figure 8:
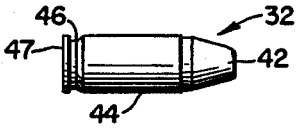
Figure 6:
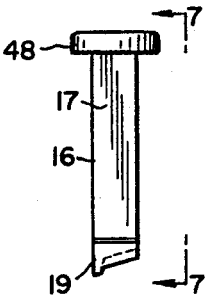
Figure 7:
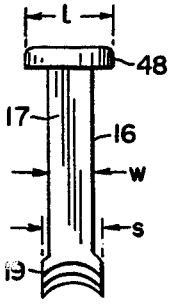
Figure 9:
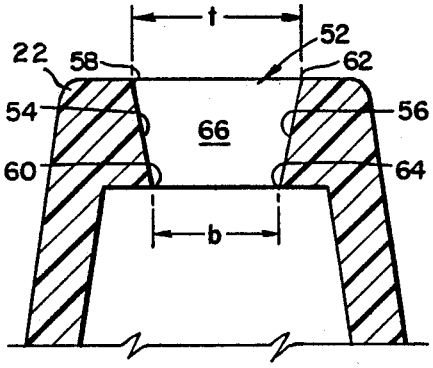
Figure 11:
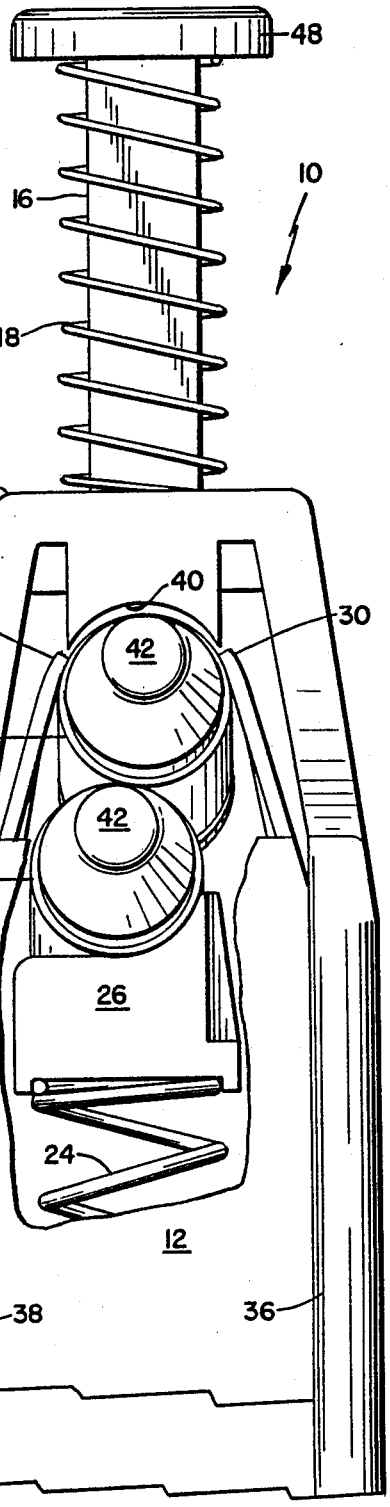
Figure 10:
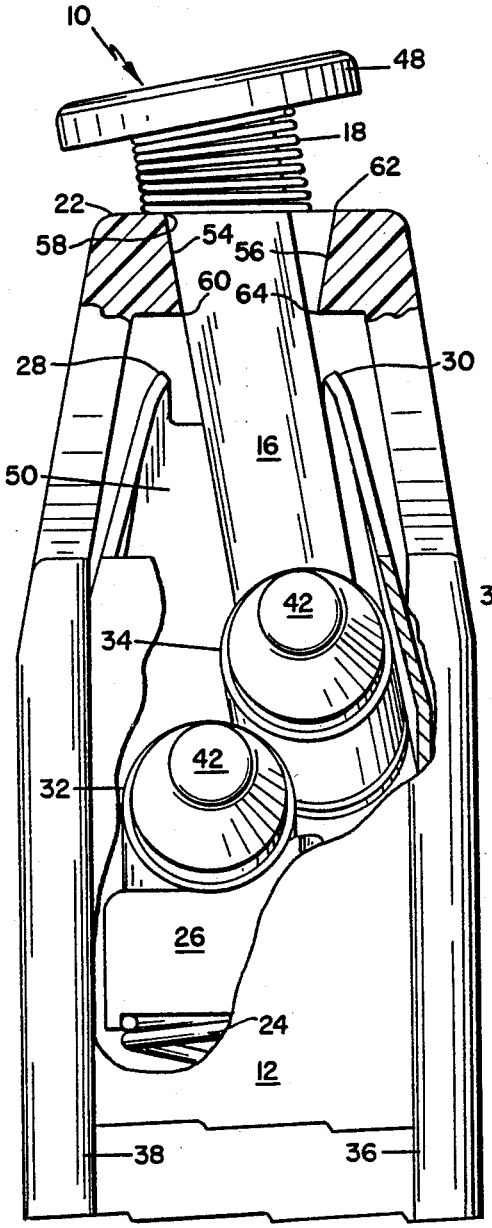

Additional objects and advantages of the present invention will be apparent to those skilled in the art by reference to the following detailed description and drawings wherein:

FIG. 1 is a side view of a magazine charger of the present invention shown approximately full scale; and FIG. 2 is a top view taken along line 2—2 of FIG. 1; and FIG. 3 is a sectional view taken along line 3—3 of FIG. 1; and FIG. 4 is a sectional view taken along line 4—4 of FIG. 3; and FIG. 5 is an oblique side view taken along line 5—5 of FIG. 4; and FIG. 6 is a side view of a plunger useful with the magazine charger of the present invention; and FIG. 7 is a side view taken along line 7—7 of FIG. 6; and FIG. 8 is a side view of a cartridge which can be charged to a magazine by use of the magazine charger of the present invention; and FIG. 9 is an enlarged sectional view taken along line 9—9 of FIG. 4; and FIG. 10 is an enlarged partially cut away view of the magazine charger of the present invention with the plunger depressed, viewed generally from the right hand side of FIG. 1 on an enlarged scale; and FIG. 11 is a view similar to that of FIG. 10 but with the plunger upwardly extended.

The above and other objects are accomplished according to the present invention by providing a magazine charger comprising a body, a plunger, and a plunger spring. The body has an open end which constitutes means for receiving a magazine to be charged with cartridges. The magazine has a magazine spring. The body further comprises a closed end which is opposite the open end. The closed end of the body has a passage with outwardly flared sidewalls. The plunger is axially, slidably carried in the passage in the closed end of the body of the charger. The plunger is adapted to move cartridges against the magazine spring. The plunger spring biases the plunger away from the open end of the charger.

In a preferred embodiment, the plunger is operable to sequentially depress the uppermost cartridge thereby facilitating feeding of cartridges to the magazine.

Referring now to the drawings in general and to FIG. 1 in particular, there is shown a magazine charger 10 of the present invention. The charger 10 is especially useful for charging 9 mm cartridges to a magazine 12. The charger 10 comprises a body 14, a plunger 16 and a plunger spring 18.

In the embodiment shown, the body 14 is constructed of a single piece of resinous thermoplastic. The body 14 has an open end 20 and a closed end 22 (see FIG. 4). The open end 20 constitutes means for receiving the magazine 12.

The charger 10 of the present invention is adapted to be used with a conventional well-known magazine 12. In such a magazine 12, there is a cartridge follower 26 which is biased toward the open end of the magazine 12 by a magazine spring 24.

The significant structural features of the known magazine 12 are best understood by looking briefly at FIGS. 10 and 11. As shown therein, the magazine 12 is equipped with a magazine spring 24 which upwardly urges a cartridge follower 26. The magazine 12 terminates in a left lip 28 and a right lip 30. The lips 28, 30 are juxtaposed with respect to each other; they are cartridge-retaining lips which keep the cartridges within the magazine. In order to perform this function, they are spaced from each other a distance less than the diameter of a single cartridge such as the cartridges 32, 34.

Referring now to FIGS. 1 through 5 inclusive, it can be seen that the body 14 carries legs 36, 38. The distance "d" (see FIG. 5) between the legs 36, 38 is less than the width of the magazine 12. This causes the legs 36, 38 to tightly and firmly grip the magazine 12.

The body 14 of the charger 10 also carries a fixed saddle 40 the surface of which is lower than the cartridge-retaining lips 28, 30 of the magazine 12 (see FIGS. 9 and 10). As explained more completely below, insertion of a cartridge, such as the cartridge 34, into the magazine 12 causes the cartridge 34 to slide along the fixed saddle 40 while remaining out of contact with the lips 28, 30.

Referring now to FIGS. 6 and 7, it can be seen that the plunger 16 comprises a shaft 17 of given width "w". One end of the shaft 17 is fixedly attached to the top 48. The top 48 has a diameter "L" which is far greater than the width "w" of the shaft. The other end of the shaft 17 is fixedly attached to a plungersaddle 19. The width "s" of the plunger-saddle 19 is slightly greater than the width "w" of the shaft 17.

Referring now to FIGS. 1, 6 and 7, it can be seen that the plunger 16 is axially slidably carried by the closed end 22 of the body 14 (see FIG. 3). Furthermore, as shown in FIGS. 9 and 10, the plunger 16 is adapted to move cartridges such as the cartridges 32, 34 against the magazine spring 24. Thus, the plunger 16 is operable to sequentially depress the uppermost cartridge 32, or 34 facilitating the feeding of additional cartridges to the magazine 12. The plunger 16 contacts the uppermost cartridge 32 behind the forward edge of the cartridge-retaining lips 28, 30. The plunger 16 has a stroke which is greater than the diameter of a single cartridge, such as the cartridge 32, in order to depress the cartridge 32 downwardly a distance sufficient to insert a cartridge such as the cartridge 34.

As shown in FIG. 8, a typical 9 mm cartridge 32, such as the cartridge 32, comprises a projectile 42 held in a casing 44. The casing 44 is provided with an extractor recess 46 and a rim 47.

As can be seen in FIG. 9, the closed end 22 of the charger 10 has a plunger-receiving passage 52. The passage 52 comprises a planar left sidewall 54 and a planar right sidewall 56. The left sidewall 54 has a top edge 58 and a linear bottom edge 60. Similarly, the right sidewall 56 has a top edge 62 and a linear bottom edge 64.

The sidewalls 54, 56 are outwardly flared such that the distance "t" between their top edges 58, 62 is greater than the distance "b" between their bottom edges 60, 64. Furthermore, the distance "b" between the bottom edges 60, 64 of the sidewalls 54, 56 is slightly greater than the width "w" of the shaft 17 of the plunger 16. (See FIG. 7). However, the distance "b" is slightly less than the width "s" of the plunger-saddle 19.

The passage 52 also comprises a planar back wall 66 joining the back of the left sidewall 54 to the back of the right sidewall 56. Similarly, a planar front wall 68 joins the fronts of the sidewalls 54, 56.

In order to assemble the charger 10, the plunger 16 is inserted in the plunger-receiving passage 52 by forcing the plunger-saddle 19 past the bottom edges 60, 64 of the sidewalls 54, 56. The sidewalls 54, 56 expand slightly and the plunger-saddle 19 contracts slightly until the plunger-saddle 19 passes beyond the bottom edges 60, 64, whereupon the plunger-saddle 19 and the bottom edges 60, 64 regain their original shape. The plunger-saddle 19 then prevents removal of the plunger 16 from the passage 52.

In operation, the magazine charger 10 is employed to charge a magazine as follows. An empty magazine is first charged with a cartridge 32 in any convenient manner or in the manner described below. Thereafter, finger pressure is applied on the top 48 of the plunger 16 causing the plunger 16 to downwardly move a full stroke. At this point, the plunger spring 18 is fully compressed as shown in FIG. 10. Furthermore, the first cartridge 32 is moved away from the saddle 40. It is also moved downwardly against the upward force of the magazine spring 24. This leaves a space 50 between the saddle 40 and the first cartridge 32. This space 50 is ideally adapted to receive a second cartridge 34. Next, a second cartridge 34 is manually inserted in the space 50 between the saddle 40 and the first cartridge 32. The second cartridge 34 is moved rearwardly until the rim 47 of the cartridge 34 lightly contacts the plunger 16.

Next, finger pressure on the top 48 of the plunger 16 is released permitting the plunger 16 to rise under the influence of the force exerted by the plunger spring 18 thus permitting the plunger 16 to assume the position shown in FIG. 11.

In this manner, the plunger 16 is no longer behind the cartridge 34. The cartridge 34 is further manually inserted until the rim 47 of the cartridge 34 contacts the rear wall (not shown) of the magazine 12.

In order to fill the magazine 12 with cartridges to capacity, it is only necessary to continually repeat the above steps in the order recited. Because the sidewalls 54, 56 are outwardly flared, the plunger-saddle 19 can follow each cartridge whether the cartridge is in the left row as in the case of the cartridge 32 or in the right row as in the case of the cartridge 34.

The charger 10 of the present invention can be constructed of a wide variety of materials. Thus, the charger 10 can be metal or plastic. The preferred materials are resinous thermoplastics such as polypropylene or nylon. Nylon 66 is the most preferred material.

The charger 10 of the present invention can be employed with a wide variety of cartridges. However, it is especially useful with the standard 9 mm cartridge having an outside diameter of about 9.9 mm and having a length of about 27 mm. Such cartridges are too short to be manually charged to a magazine with any facility whatsoever.

Although the invention has been described in considerable detail with reference to certain preferred embodiments thereof, it will be understood that modifications can be made without departing from the spirit of the invention as defined above and as described in the following claims.

What is claimed is:

1. A magazine charger for charging cartridges to a magazine adapted to house first and second parallel rows of cartridges; said magazine charger comprising;

A. a body comprising:

(1) an open end constituting means for receiving a magazine to be charged with cartridges; wherein the magazine has a magazine spring; and (2) a closed end opposite the open end; and (3) a plunger-receiving passage in the closed end; said plunger-receiving passage having outwardly flared sidewalls; and B. a plunger axially, slidably carried in the plunger-receiving passage of the closed end of the body of the charger and adapted to move cartridges against the magazine spring; and C. a plunger spring which biases the plunger away from the open end of the charger;

whereby the plunger is operable to sequentially depress the uppermost cartridge, thereby alternately feeding the cartridges to the first and second parallel rows of cartridges in the magazine.

2. The charger of claim 1 for use with a magazine having cartridge-retaining lips spaced from each other a distance less than the diameter of a single cartridge.

3. The magazine charger of claim 2 wherein the plunger contacts the uppermost cartridge in the magazine behind the forward edge of the cartridge retaining lips.

4. The magazine charger of claim 1 wherein the plunger has a stroke which is greater than the diameter of a single cartridge.

5. The magazine charger of claim 1 wherein the body is constructed from a single piece of material.

6. The magazine charger of claim 1 wherein the body is constructed from a resinous thermoplastic.

7. The magazine charger of claim 6 wherein the resinous thermoplastic is polypropylene.

8. The magazine charger of claim 6 wherein the resinous thermoplastic is nylon.

9. The magazine cartridge of claim 1 wherein the body further comprises two legs which are juxtaposed and are spaced from each other by a distance less than the width of the magazine thereby causing the legs to tightly and firmly grip the magazine.

10. A magazine charger for charging cartridges to a magazine adapted to house first and second parallel rows of cartridges; said magazine charger comprising:

A. a body comprising:

(1) an open end constituting means for receiving a magazine to be charged with cartridges; wherein the magazine has a magazine spring; and (2) a closed end opposite the open end; and (3) a plunger-receiving passage in the closed end; said plunger-receiving passage comprising:

(a) a planar left sidewall having a top edge and a linear lower edge; and (b) a planar right sidewall having a top edge and a linear lower edge; and (c) a planar back wall joining the back of the left sidewall to the back of the right sidewall; and (d) a planar front wall joining the front of the left sidewall to the front of the right sidewall; and B. a plunger comprising a shaft of given width wherein one end of the shaft is fixedly attached to a top whose diameter is far greater than the width of the shaft; wherein the other end of the shaft is fixedly attached to a plunger-saddle whose width is slightly greater than the width of the shaft;

whereby the plunger is inserted in the plunger-receiving passage by forcing the plunger-saddle past the bottom edges of the sidewalls; and whereby the plunger-saddle prevents removal of the plunger from the plunger-receiving passage; and whereby the plunger is operable to sequentially depress the uppermost cartridge thereby alternately feeding the cartridges to the first and second parallel row of cartridges in the magazine.

11. A magazine charger for charging cartridges to a magazine adapted to house first and second parallel rows of cartridges; said magazine charger comprising;

A. a body comprising:

(1) an open end constituting means for receiving a magazine to be charged with cartridges; wherein the magazine has a magazine spring which biases cartridges toward two juxtaposed, cartridge-retaining lips carried by the magazine; and (2) a closed end opposite the open end; and (3) a saddle, the surface of which is lower than the cartridge-retaining lips of the magazine;

whereby insertion of a cartridge into the magazine causes the cartridge to slide along the saddle while remaining out of contact with the lips of the magazine; and (4) a plunger-receiving passage in the closed end; said plunger-receiving passage having outwardly flared sidewalls; and B. a plunger axially, slidably carried in the plunger-receiving pasage of the closed end of the body of the charger and adapted to move cartridges against the magazine spring; and C. means for biasing the plunger away from the open end of the charger.

12. A magazine charger for charging cartridges to a magazine adapted to house first and second parallel rows of cartridges; said magazine charger comprising;

A. a body comprising:

(1) an open end constituting means for receiving a magazine to be charged with cartridges; wherein the magazine has a magazine spring; and (2) a closed end opposite the open end; and (3) two juxtaposed depending legs attached to the body wherein the legs constitute means for gripping tne magazine; and (4) a plunger-receiving passage in the closed end; said plunger-receiving passage having outwardly flared sidewalls; and B. a plunger axially, slidably carried in the plunger-receiving passage of the closed end of the body of the charger and adapted to move cartridges against the magazine spring; and C. a means for biasing the plunger away from the open end of the charger.

13. A magazine charger for charging cartridges to a magazine adapted to house first and second parallel rows of cartridges; said magazine charger comprising:

A. a single-piece body of resinous thermoplastic material comprising:

(1) an open end constituting means for receiving a magazine to be charged with cartridges;

wherein the magazine has a magazine spring which biases cartridges toward two juxtaposed, cartridge-retaining lips carried by the magazine;

wherein the cartridge-retaining lips are spaced from each other a distance less than the diameter of a single cartridge;

(2) a closed end opposite the open end; and (3) two juxtaposed depending legs attached to the body wherein the legs constitute means for gripping the magazine;

wherein the two legs are spaced from each other by a distance less than the width of the magazine thereby causing the legs to tightly and firmly grip the magazine; and (4) a fixed saddle, the surface of which is lower than the cartridge-retaining lips of the magazine;

wherein insertion of a cartridge into the magazine causes the cartridge to slide along the saddle while remaining out of contact with the lips of the magazine; and (5) a plunger-receiving passage in the closed end; said plunger-receiving passage having outwardly flared sidewalls; and wherein the plunger is axially, slidably carried in the plunger-receiving passage of the closed end of the body of the charger and is adapted to move cartridges against the magazine spring; and whereby the plunger is operable to sequentially depress the uppermost cartridge facilitating feeding of the cartridges to the magazine; and wherein the plunger contacts the uppermost cartridge in the magazine behind the forward edge of the cartridge-retaining lips; and wherein the plunger has a stroke which is greater than the diameter of a single cartridge; and B. means for biasing the plunger away from the open end of the charger; said means constituting a spring which surrounds the plunger and biases the upper edge of the plunger away from the body of the magazine;

whereby the charger is used to charge a magazine by:

I. first applying finger pressure on the plunger causing the plunger to downwardly move a full plunger stroke completely compressing the plunger spring thereby moving a first cartridge away from the saddle and moving the first cartridge downwardly against the upper face of the magazine spring thereby leaving a space between the saddle and the first cartridge; and then II. manually inserting a second cartridge in the space between the saddle and the first cartridge by moving the cartridge rearwardly until the rim of the cartridge lightly contacts the plunger; and then III. releasing finger pressure on the top of the plunger thereby permitting the plunger to rise under the influence of the force exerted by the plunger spring; and then IV. further manually inserting the cartridge until the cartridge contacts the rear wall of the magazine; and then V. continually repeating Steps I, II, III and IV in that order until the magazine is filled to capacity with cartridges.

* * * * *